US006745686B1

(12) United States Patent
Frick et al.

(10) Patent No.: US 6,745,686 B1
(45) Date of Patent: Jun. 8, 2004

(54) BEARING FOR A CYLINDRICAL SIEVE IN ROTATION SIEVE PRINTING WORKS

(75) Inventors: Hans-Rudolf Frick, Thal (CH); Heinz Brocker, Herisau (CH); Siegfried Grueninger, St. Gallen (CH)

(73) Assignee: Gallus Ferd, Ruesch AG, Gallen (CH)

( * ) Notice: Subject to any disclaimer, the term of this patent is extended or adjusted under 35 U.S.C. 154(b) by 0 days.

(21) Appl. No.: 10/110,257

(22) PCT Filed: Oct. 5, 2000

(86) PCT No.: PCT/CH00/00546

§ 371 (c)(1),
(2), (4) Date: Aug. 15, 2002

(87) PCT Pub. No.: WO01/26905

PCT Pub. Date: Apr. 19, 2001

(30) Foreign Application Priority Data

Oct. 8, 1999 (EP) ..... 99120101

(51) Int. Cl.[7] ..... B41F 15/38

(52) U.S. Cl. ..... 101/127.1; 101/128.1; 101/116

(58) Field of Search ..... 101/127.1, 128.1, 101/116, 114, 216

(56) References Cited

U.S. PATENT DOCUMENTS

| | | | | |
|---|---|---|---|---|
| 3,599,565 A | * | 8/1971 | Feier et al. | 101/116 |
| 3,837,277 A | * | 9/1974 | Jaffa et al. | 101/127.1 |
| 3,971,313 A | * | 7/1976 | Voegelin | 101/127.1 |
| 4,164,184 A | | 8/1979 | Vertegaal | |
| 4,384,521 A | * | 5/1983 | Muselaers | 101/116 |

* cited by examiner

*Primary Examiner*—Leslie J. Evanisko
(74) *Attorney, Agent, or Firm*—Kenyon & Kenyon

(57) ABSTRACT

A support for a cylindrical screen in a rotation screen printing apparatus. The apparatus has two sides. The support includes a side flange on each of the two ends of the apparatus; an intermediate ring resiliently supported by each side flange; a turnbuckle rotatable rotatably disposed in each intermediate ring; a stencil ring disposed in each turnbuckle. Whereby the screen is received at each end of the apparatus through the stencil rings in a turnbuckle, so that when subjected to a load, the screen is able to pivot and be displaced in an axial direction relative to the flange at least within predetermined limits.

7 Claims, 2 Drawing Sheets

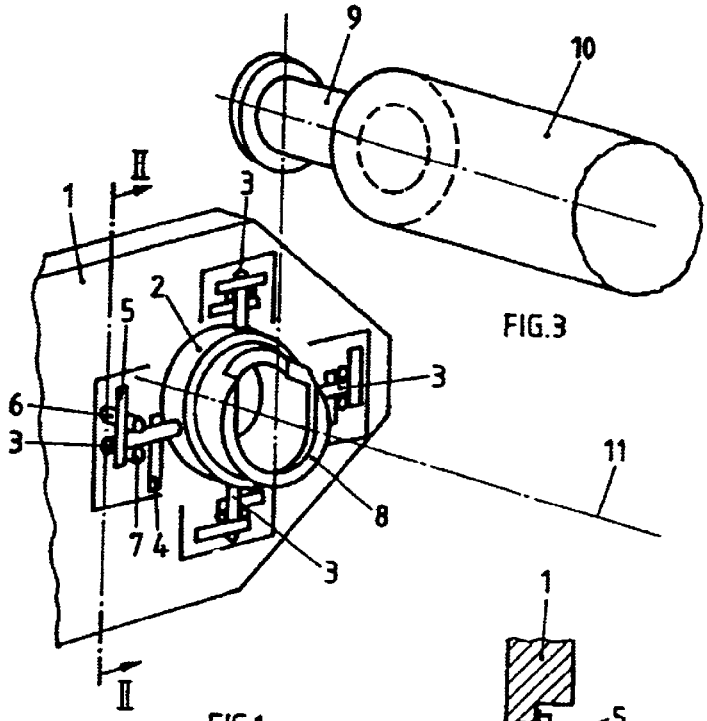
FIG.3
FIG.1
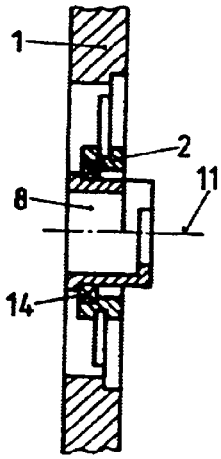
FIG.4
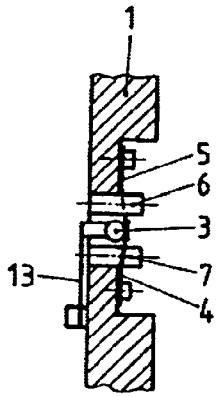
FIG.2

BEARING FOR A CYLINDRICAL SIEVE IN ROTATION SIEVE PRINTING WORKS

BACKGROUND OF THE INVENTION

A support for a cylindrical screen in a rotation screen printing apparatus, wherein the screen is received at both sides of the apparatus in a respective turnbuckle. The turnbuckle is supported for rotation in an intermediate ring.

Printing outlines for the rotation screen printing are produced out of so called SCREENY® screen printing plates that are mounted in the printing apparatus as cylinders. This material consists of a fine mesh stabilized steel fabric and is allowed to be loaded only by tension (axial loading of the cylindrical screen). As much as possible, uniform screen tension at standstill is to be sought, because during the printing process, the doctor blade located inside, exerts in additional and differing moment of torsion.

Locally, highly differing screen tensions cause the formation of waves at the circumference of the screen.

The inherent stability of the screen is ensured by the cylindrical shape.

When mounting, and during the printing process, the screen is variously loaded due to a plurality of reasons:

- the design of turnbuckle with the conventional U-shaped recess causes at a axial loading and a tilting of the bearing.
- The devices for the production of the screens have deviations, or may be soiled by residual adhesive agents, so that the outer stencil rings are not aligned precisely to each other.
- At the axial tension, which is necessary for the screen, the side plates with the bearing are deformed so that the directions of the axes extend at an angle relative to each other.
- General tolerances in printing apparatus can lead to various mistakes, e.g., to a deviation from the coaxial position of the positions of the bearings relative to each other.

Experience has shown that the pivotal movement at the sides of screens for a compensation of all causes shall amount maximally up to 0.5°. When no compensation can take place, the forming of waves at the printing screen is observed. These waves shorten the useful lifetime of the screen and lead to early failures of screens and to losses of the quality of the print.

Also, the screen cannot transmit any moments. Thus, an equalizing without a restoring moment must proceed practically without any force.

OBJECTS OF THE INVENTION

It is an object of the present invention to find a screen support that can equalize under an axial loading all influences for an unequal screen tension.

The proven turnbuckle with a U-shaped receptacle is used. The support is planar design and that lends itself to an integrating at both sides in the side plates.

A simple spherical support may indeed provide an equalization. Such a configuration, necessitates however, a large expenditure regarding the design for axial movements. The reliable functioning of a large embracement is needed, otherwise the ball acts like wedge. Should it be designed as a spherical sleeve bearing, the dimension of the design and speed of rotation are critical.

A purely universal joint bearing features similar drawbacks.

This solutions includes substantially a planar intermediated ring that is held resiliently in the side flange so that besides a pivoting relative to the side flange, a displacing in axial direction is also possible.

BRIEF DESCRIPTION OF THE FIGURES

Specific embodiments of the invention are defined in the dependent claims. The invention will be explained below more in detail with reference to embodiments illustrated in the drawings. There is shown in:

FIG. 1 is a perspective view of the inner side of a side flange of a screen printing apparatus with a support in accordance with the invention for the screen printing cylinder mounted in the flange;

FIG. 2 is a schematic vertical section along the line II—II of FIG. 1;

FIG. 3 is one of the ends of a screen printing cylinder set onto a stencil ring;

FIG. 4 is a vertical section through the screen printing cylinder axis in the area of turnbuckle and intermediate ring;

DETAILED DESCRIPTION OF THE FIGURES

Figure 5:
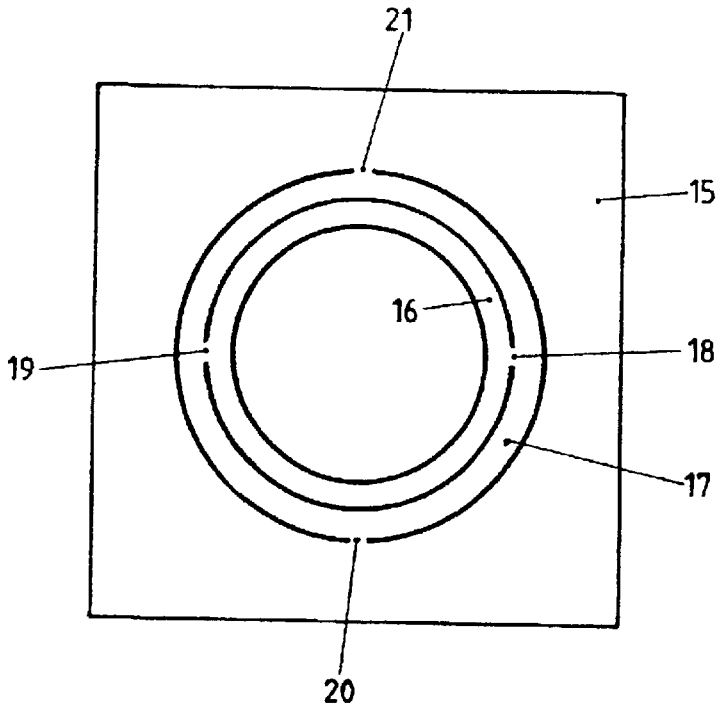
FIG. 5 is a schematic view of a plate with integrated intermediate ring (of two concentric rings interconnected through resilient webs) foreseen for the insertion into a printing apparatus flange as variant of the support.

FIGS. 1 to 4 illustrate a first embodiment of a support in accordance with the invention in a side flange 1 of a screen printing apparatus. A intermediate flange 2 for a rotating receipt of the conventional turnbuckle 8 is thereby foreseen, whereby the stencil ring 9 (FIG. 3) supporting the screen cylinder is set into the U-shapes receptacle of the turnbuckle 8.

The intermediate ring 2 is supported by its four cylinder pins 3 staggered relative to each other by 90°, respectively. Pins 3 are held by two leaf springs 4,5 and centered towards the center. A third spring 13 at the back side of flange 1 holds the intermediate ring 2 in a tensionless state (equilibrium of forces). For the positioning of pins 3, two cylinder shaped pins 6,7 for each pin 3, located at a distance from each other, and projecting from the flange 1, are utilized.

Due to this support, the screen printing cylinder can attain any position occurring during the operation (when subject to a loading it can pivot resiliently relative to the flange 1 and shift in axial direction also against the action of the springs).

The resilient stroke at an axial loading is determined by the leaf springs. It is advantageous when the one side includes stronger springs so that upon a change of a loading the screen printing cylinder is displaced a relatively small amount.

FIG. 2 illustrates specifically the arrangement and action, respectively, of the springs 4, 5 and 13 acting onto the cylinder pins 3.

FIG. 4 illustrates the arrangement of the turnbuckle 8 that is received in the intermediate ring 2 via thin ring bearings 14.

FIG. 5 schematically illustrates a variant of a support in accordance with the invention. Two concentric rings 16,17, each with two resilient connecting webs 18, 19 and 20, 21, respectively, are worked into a plate 15. The webs are staggered relative to each other by 180° (the position of the inner webs 18, 19 is staggered relative to the outer webs 20, 21 by 90°).

This flexible (spring elastic) support can equalize specifically planar running faults (wobble movements of the axis) and allows pivoting movements thereto and relatively slight axial displacements.

Figure 6:
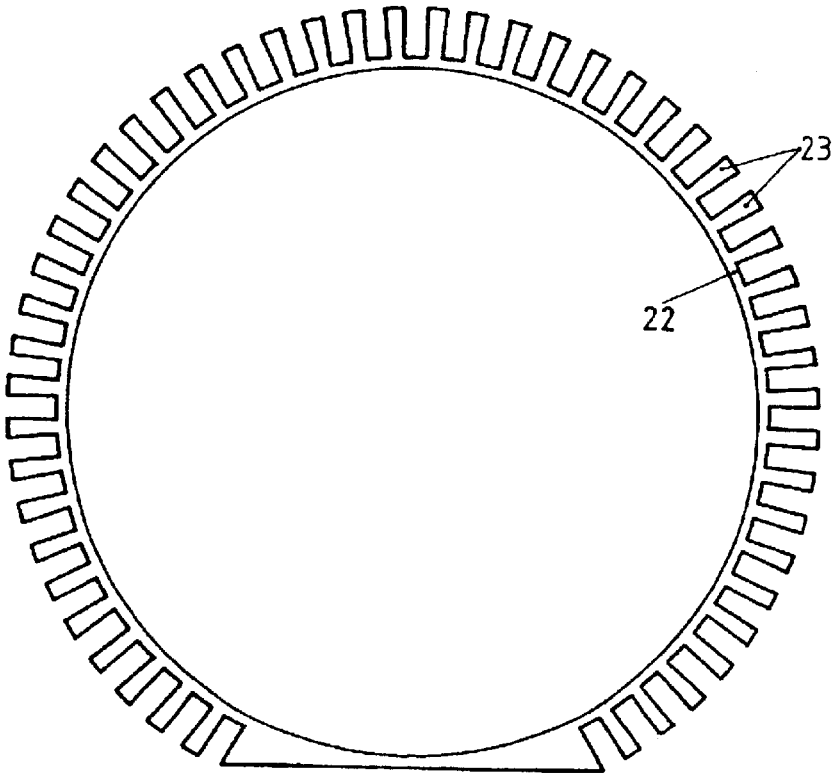
FIG. 6 is a further variant of the support in accordance with the invention, specifically the intermediate ring consisting of a inner base ring with spring tongues projecting radially outwards in its plane.

FIG. 6 illustrates finally a further variant of a resilient support for the intermediate ring. It consists of an inner base ring 22 and a plurality of leaf springs 23 extending in its plane radially outwards.

The intermediate ring is set into the base ring, whereas the outer ends of the leaf springs are held laterally in the flange. This specifically simple embodiment can meet the same demands regarding capacity of pivoting and slight axial displacement as the above describes supports.

What is claimed is:

1. A support for a cylindrical screen in a rotation screen printing apparatus, the apparatus having two ends, a side flange on each of the two ends of the apparatus, the support comprising:

an intermediate ring resiliently supported by each side flange;

a turnbuckle rotatably disposed in each intermediate ring;

a stencil ring disposed in each turnbuckle, wherein the screen is receivable at each end of the apparatus through the stencil rings in each turnbuckle, so that when subjected to a load, the screen is pivotable and displaceable in an axial direction relative to each side the flange at least within predetermined limits.

2. The support according to claim 1, further comprising:

two planar concentric rings supported by each side flange and that are configured to engage the intermediate ring, whereby an inner ring is in connection through two inner connecting webs located diametrically opposite to each other to an outer ring, whereas the outer ring is in connection through two diametrically opposite webs that are staggered by 90° relative to the inner connecting webs with a support surrounding the outer ring.

3. The support according to claim 2, wherein the two planar concentric rings and the side flanges are integrated in a plate.

4. The support according to claim 1, further comprising:

four radially projecting pins, staggered by 90° relative to each other, on the intermediate ring, the pins are held at the corresponding side flange so that the intermediate ring cannot rotate around its axis, the pins allow at least one of a relatively slight pivoting and displacing of the intermediate ring in the axial direction, respectively, relative to the flange against the force of restoring springs.

5. The support according to claim 4, further comprising:

guiding pins at the side flange for supporting the pins of the intermediate ring, wherein two guiding pins support each of the pins of the intermediate ring;

leaf springs acting from a front and a rear onto the pins so that the intermediate ring is held in a tensionless state independent from any axial load.

6. The support according to claim 1, further comprising:

planar, annular spring elements for holding each intermediate ring, the spring elements being mounted in the side flange, the elements comprising a base ring and a plurality of leaf springs projecting from the base ring, radially in a plane of the base ring, wherein the intermediate ring sits firmly on the base ring and the leaf springs are held only at their outer ends.

7. A rotation screen printing apparatus comprising:

a cylindrical screen having two ends and a stencil ring disposed on each of said two ends;

a support for supporting the cylindrical screen at each end, said support comprising:

a side flange located adjacent each of the two ends of the screen;

an intermediate ring resiliently supported by each side flange; and a turnbuckle rotatably disposed in each intermediate ring;

wherein the screen is supported in the side flanges by each stencil ring of the screen being disposed in its associated turnbuckle, so that when the screen is subjected to a load, the screen is able to pivot and be displaced in an axial direction relative to each flange at least within predetermined limits.

* * * * *